United States Patent [19]

Fuemmeler

[11] 4,120,446

[45] Oct. 17, 1978

[54] NEWSPAPER DELIVERY RECEPTACLE

[76] Inventor: Vincent F. Fuemmeler, 514 Teal Lake Rd., Mexico, Mo. 65265

[21] Appl. No.: 772,666

[22] Filed: Feb. 28, 1977

Related U.S. Application Data

[63] Continuation of Ser. No. 618,009, Sep. 30, 1975, abandoned.

[51] Int. Cl.[2] ..... B65D 91/00

[52] U.S. Cl. ..... 232/17; 232/39; 248/204

[58] Field of Search ..... 232/17, 39; 248/223, 248/224, 225, 260, 204, 360, 272; 24/230 SL, 230 BC, 201 A

[56] References Cited

U.S. PATENT DOCUMENTS

| | | | |
|---|---|---|---|
| 477,819 | 6/1892 | Pforr | 24/230 BC |
| 951,700 | 3/1910 | Robert | 248/260 |
| 1,228,256 | 5/1917 | Stoll | 24/230 SL |
| 1,252,982 | 1/1918 | Alley et al. | 248/272 |
| 2,303,053 | 11/1942 | Kneedler | 24/230 SL |
| 2,771,263 | 11/1956 | Bomo | 248/224 X |
| 3,525,427 | 8/1970 | Kulka | 24/230 SL |
| 3,601,431 | 8/1971 | Henley | 24/230 SL |
| 3,631,572 | 1/1972 | Lange | 24/223 |

FOREIGN PATENT DOCUMENTS

| | | | |
|---|---|---|---|
| 884,747 | 11/1971 | Canada | 232/39 |

*Primary Examiner*—Roy D. Frazier
*Assistant Examiner*—Peter A. Aschenbrenner
*Attorney, Agent, or Firm*—Koenig, Senniger, Powers and Leavitt

[57] ABSTRACT

A newspaper delivery receptacle or tube having a bottom, sides and a top, closed at one end constituting its back end and open at its front end. The receptacle is mounted in a generally horizontal position on a post by means of a bracket having a vertical leg adapted to be fastened to the post and a horizontal leg extending laterally outwardly from the vertical leg to be slidably engaged with the bottom of the receptacle. This bracket leg has an opening and the bottom of the receptacle has a boss constituting a snap fastener so that as the receptacle is slid into engagement with the bracket the boss will snap into the opening thereby fastening the receptacle to the bracket.

9 Claims, 9 Drawing Figures

NEWSPAPER DELIVERY RECEPTACLE

This is a continuation of application Ser. No. 618,009, filed Sept. 30, 1975, now abandoned.

BACKGROUND OF THE INVENTION

This invention relates to newspaper delivery receptacles and more particularly to means for mounting such a receptacle in horizontal position on a post or the like.

This invention represents an improvement on newspaper delivery receptacles as heretofore known, such as exemplified by U.S. Pat. No. 3,047,213, issued July 31, 1962, and U.S. Pat. No. 3,556,393, issued Jan. 19, 1971. Heretofore the mounting means for newspaper delivery receptacles has usually involved a bracket on the post and some type of conventional fastening means (usually bolt and nut assemblies and projecting studs) for securing the receptacle to the bracket. These mounting arrangements entail excessive installation time and require supplying these hardware components.

SUMMARY OF THE INVENTION

Among the several objects of this invention may be noted the provision of improved means for mounting a newspaper delivery receptacle on a bracket on a post which eliminates the need to use bolts to secure the receptacle to the bracket; the provision of such mounting means enabling quick and easy fastening of the receptacle to the bracket without the use of tools; and the provision of such mounting means which utilizes part of the bottom of the receptacle itself as a fastener element.

Other objects and features will be in part apparent and in part pointed out hereinafter.

Briefly, the invention involves a newspaper delivery receptacle having a bottom, sides and a top, and which is closed at one end constituting its back end and open at its front end for insertion of a newspaper therein. The receptacle has means for mounting it in a generally horizontal position on a post. The means include a bracket having a vertical leg to be fastened to the post and a horizontal leg extending laterally outwardly from the vertical leg to be slidably engaged with the bottom of the receptacle. The bottom of the receptacle and the horizontal leg have interengageable snap fastener means for snap fastening of the receptacle to the horizontal leg by sliding the receptacle in the direction transverse to its length and longitudinally of the horizontal leg onto the horizontal leg with the side margins of the horizontal leg in said grooves.

BRIEF DESCRIPTION OF THE DRAWINGS

Corresponding reference characters indicate corresponding parts throughout the several view of the drawings.

DESCRIPTION OF THE PREFERRED EMBODIMENT

Figure 1:
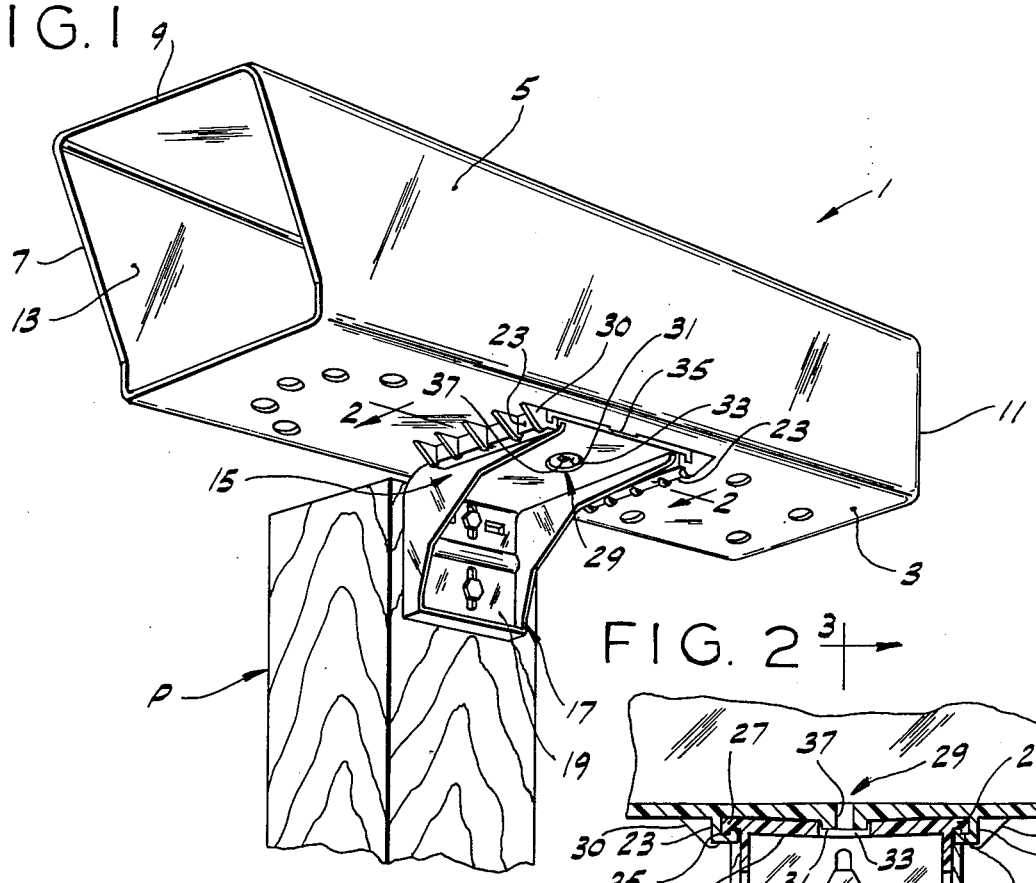
FIG. 1 is a perspective of a newspaper delivery receptacle of this invention mounted on a post.

Referring to the drawings, FIG. 1 shows a newspaper delivery receptacle or tube of this invention, generally designated by the reference numeral 1, having a bottom 3, sides 5 and 7, and a top 9, closed at one end 11 constituting its back end and open at its front end 13 for insertion of a newspaper therein. Receptacle 1 may be formed or molded of synthetic resin material such as polyethylene, or fabricated from metal, if desired. At 15 is generally indicated means for mounting the receptacle in a generally horizontal position on a post P. More particularly, mounting means 15 comprises a bracket 17 having a vertical leg 19 fastened to the post P and a horizontal leg 21 extending laterally outwardly from the vertical leg, and means constituted by a pair of shoulders 23 on the outside of the bottom 3 of the receptacle for slidably receiving the horizontal leg of the bracket. The receptacle bottom 3 and the horizontal leg 21 of the bracket have interengageable snap fastener means 29 for snap fastening of the receptacle to said horizontal leg by sliding the receptacle into interengagement with the horizontal leg 21.

Figure 2:
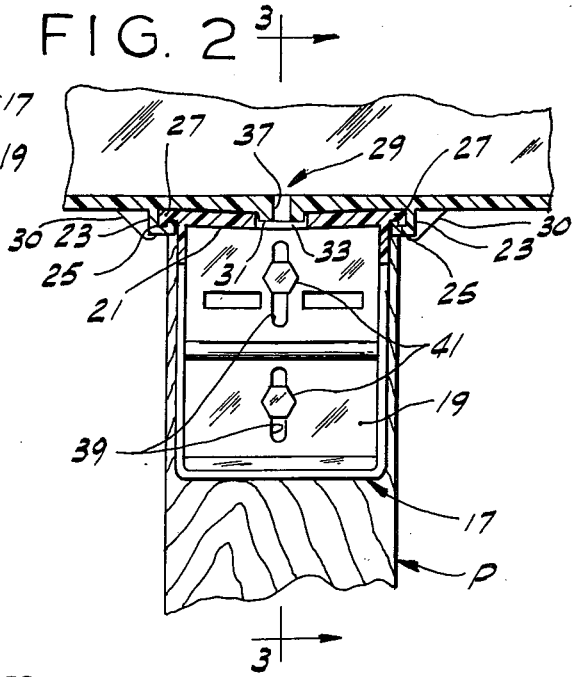
FIG. 2 is a vertical longitudinal section on line 2—2 of FIG. 1.
Figure 5:
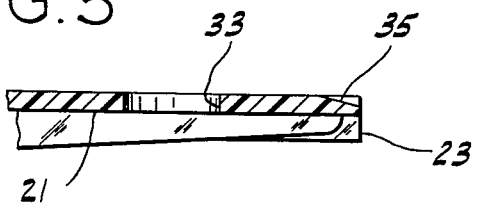
FIG. 5 is an enlarged fragment of FIG. 3 showing the horizontal leg per se of a bracket.
Figure 3:
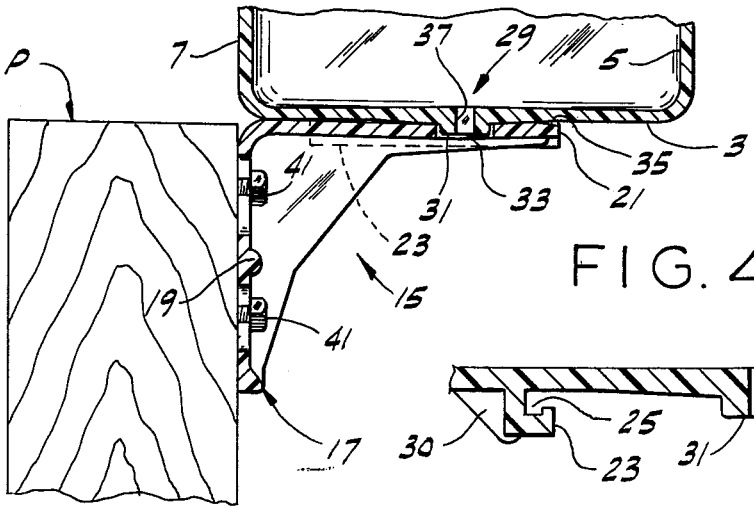
FIG. 3 is a vertical transverse section on line 3—3 of FIG. 2.
Figure 4:
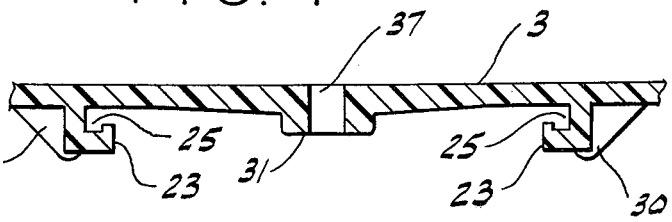
FIG. 4 is an enlarged fragment of FIG. 2 showing the bottom of the receptacle per se.

More particularly, shoulders 23, which define an open-ended channel, extend transversely across the outside of the bottom 3 of the receptacle and have grooves 25 as shown in FIG. 2 for slidably receiving side margins 27 of the horizontal leg. The portion of the receptacle bottom 3 between shoulders 23 is integral and is integrally joined to the bottom at all sides thereof, including the sides at the shoulders. The horizontal leg 21 of the bracket is also integrally formed. The portion of the tube bottom 3 extending between shoulders 23 and the horizontal leg 21 of the bracket have snap fastener means 29 for snap fastening of the receptacle 1 to the horizontal leg when the receptacle is applied to the bracket 17. This is accomplished by sliding the receptacle in the direction (right to left as viewed in FIG. 3) transverse to its length and longitudinally of the horizontal leg onto the horizontal leg from the outer end thereof with the side margins 27 of the horizontal leg in grooves 25. Since the channel defined by shoulders 23 is open at each of its ends, the receptacle may be slid onto the horizontal leg 21 with the front end 13 of the receptacle 1 toward either side of that leg (i.e., with the open end of the tube facing either toward or away from the viewer as seen in FIG. 1). The shoulders 23 are formed by ribs molded integrally with the bottom of the receptacle but it is understood that they may be separately fabricated and secured to the undersurface of tube 1. Preferably, there are gussets 30 between the shoulders 23 and the receptacle bottom 3 to provide additional strength.

More particularly, the snap fastener means 29 comprises a downwardly projecting boss 31 on the receptacle bottom 3 and a complementary opening 33 in horizontal leg 21 of the bracket for receiving the boss. The integrally formed portion of the receptacle bottom 3 between shoulders 23 is sufficiently resilient for flexing upwardly as the receptacle is slid onto the horizontal leg 21 until the boss is aligned with opening 33 in leg 21, at which point the boss snaps into the opening so as quickly and easily to secure the receptacle to the bracket without the use of any tools or bolts. It is to be understood that the snap fastener means may, in the alternative, comprise an upwardly projecting boss on horizontal leg 21 of the bracket and an opening in the bottom 3 of the receptacle to receive the boss. The portion of the receptacle bottom surrounding the boss may be somewhat thicker than the balance of the bottom of tube 1 so as to taper radially outwardly to effect a transition with the undersurface thereof, thus biasing boss 31 into firm engagement in opening 33.

The horizontal leg 21 of the bracket has a groove 35 at its outer end for boss 31, the bottom of this groove being inclined to constitute a ramp for forcing the boss upwardly as the receptacle is slid onto the horizontal leg.

Optionally boss 31 has an axial square hole 37 for the purpose of receiving a carriage bolt or the like to supplement the connection between the receptacle and the bracket, if so desired. The addition of such a bolt or the like is solely for security reasons (i.e., to inhibit the theft of the receptacle) and is not necessary for the proper functioning of the mounting means.

The vertical leg 19 of the bracket has vertical slots 39 for receiving screws 41 for attaching it to the post. The boss is preferably molded integrally on the bottom of the receptacle.

Figure 6:
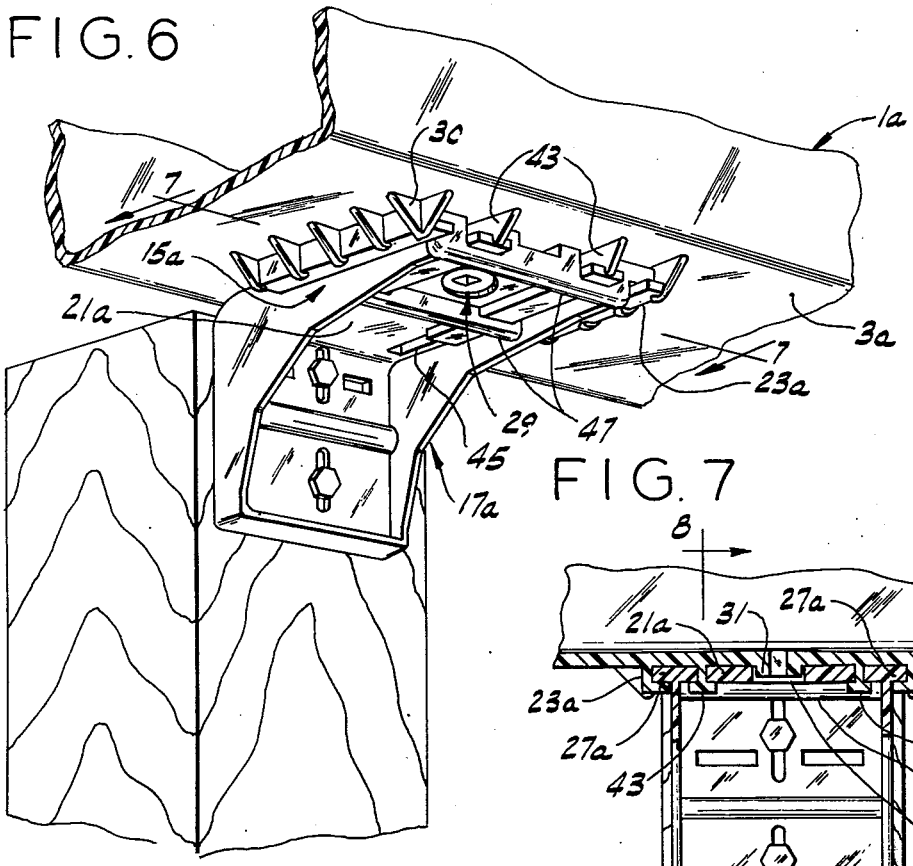
FIG. 6 is a view similar to FIG. 1 of an alternative newspaper delivery receptacle mounted on a post.
Figure 7:
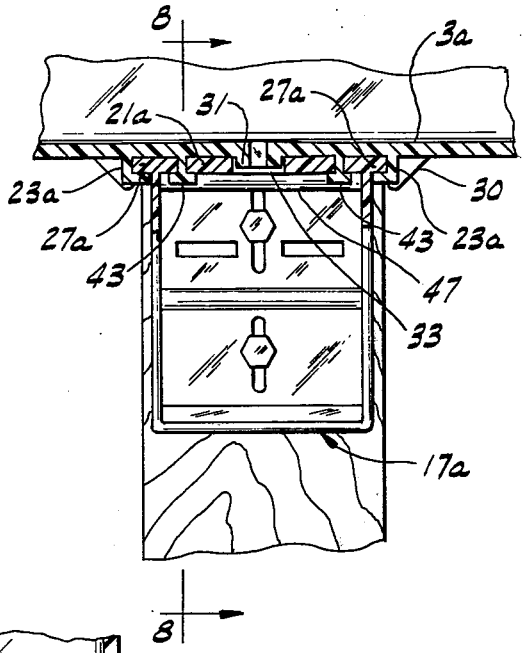
FIG. 7 is a vertical longitudinal section on line 7—7 of FIG. 6.
Figure 8:
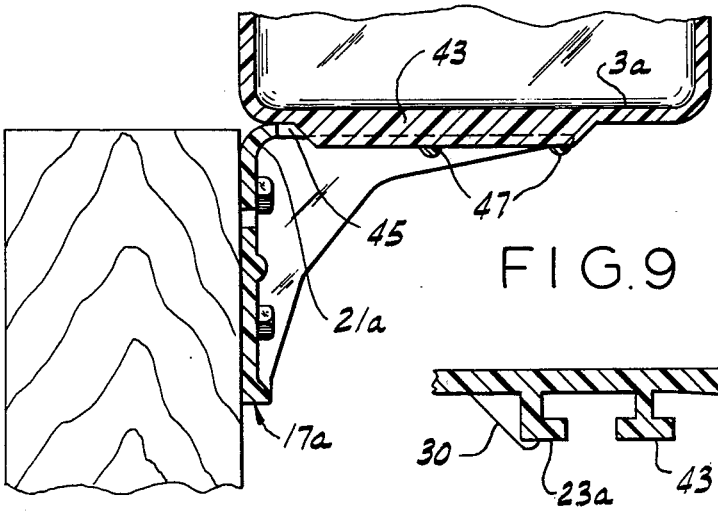
FIG. 8 is a vertical transverse section on line 8—8 of FIG. 7.
Figure 9:
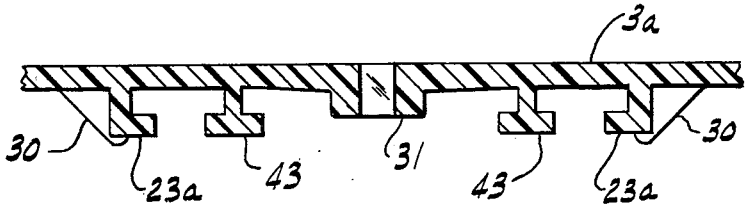
FIG. 9 is an enlarged portion of FIG. 7 showing the bottom of the receptacle per se.

FIGS. 6 through 9 show a newspaper delivery receptacle 1*a* similar to tube 1 as previously described except that a pair of ribs 43 extend transversely across the bottom of the tube 3*a* and are positioned parallel to and inwardly of shoulders 23*a* for engaging a bracket 17*a* and thereby provide mounting means 15*a* with greater impact strength. In addition, the engagement of bracket 17*a* with ribs 43 better maintains the firm bias of boss 31 into opening 33. Ribs 43 have a generally T-shaped cross section with a generally vertical web portion and a generally horizontal flange portion. As can be seen from the drawings, bracket 17*a* is similar to bracket 17 described above except that horizontal leg 21*a* has a pair of slots 45 open at the outer end of the leg. Each web portion of ribs 43 is slidably received in its respective slot and the flange portions slidably engage the margins of the respective slots on the undersurface of horizontal leg 21*a* as tube 1*a* is slid onto and secured to the bracket. Horizontal leg 21*a* also has reinforcing ribs each designated 47 extending across the undersurface of the horizontal leg. Reinforcing ribs 47 are generally perpendicular to and span slots 45 and have openings to receive the flanges of ribs 43. The portion of the receptacle bottom 3*a* between the ribs 43 and the horizontal leg have snap fastener means 29 for snap fastening the receptacle to the horizontal leg when the receptacle 1*a* is applied to the bracket 17*a*. This is accomplished by sliding the receptacle in the direction (right to left as viewed in FIG. 8) transverse to its length and longitudinally of horizontal leg 21*a* onto the horizontal leg from the outer end thereof with side margins 27*a* of the horizontal leg in shoulders 23*a* and ribs 43 in slots 45. As was the case with receptacle 1, receptacle 1*a* may also be slid onto the horizontal leg 21*a* with the front end 13*a* of the receptacle toward either side of that leg (i.e., with the open end of the receptacle facing either toward or away from the viewer as seen in FIG. 6). Although two reinforcing ribs 47 are shown in the drawings, it is understood that any number may be used without departing from the scope of this invention. It should also be understood that while ribs 43 are shown molded integrally with the bottom of the receptacle, they may be separately fabricated and secured to the undersurface of tube 1*a*.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A newspaper delivery receptacle having a bottom, sides and top, closed at one end constituting its back end and open at its front end for insertion of a newspaper therein, and means for mounting said receptacle in generally horizontal position on a post comprising a bracket having a vertical leg adapted to be fastened to the post and a horizontal leg extending laterally outwardly from the vertical leg, and means on the outside of the bottom of the receptacle for slidably receiving said horizontal leg of the bracket, said bottom having an integral portion extending between said receiving means and integrally joined to said bottom on all sides thereof including the sides at said receiving means, said horizontal leg having an integral portion extending from side to side of the horizontal leg, one of said portions having a boss and the other having an opening for receiving said boss, and at least one of said portions being adapted to flex between the sides thereof for snap-fastening the receptacle to said horizontal leg upon sliding the receptacle into interengagement with said horizontal leg, said means for slidably receiving said horizontal leg comprising a channel defined by a pair of shoulders extending transversely across the outside of the bottom of the receptacle having grooves for slidably receiving the side margins of said horizontal leg of the bracket, and said receptacle being adapted to be applied to the bracket by sliding the receptacle onto the horizontal leg of the bracket from the outer end thereof, with said channel being open at each of its ends allowing the receptacle to be slid onto the horizontal leg with the front end of the receptacle toward either side of that leg.

2. A newspaper delivery receptacle as set forth in claim 1 wherein said boss is on the bottom of the receptacle and said opening is in said horizontal leg.

3. A newspaper delivery receptacle as set forth in claim 1 wherein said integral portion of said bottom is relatively resilient for flexing upwardly between the sides thereof as the receptacle is slid onto the horizontal leg.

4. A newspaper delivery receptacle as set forth in claim 3 wherein said horizontal leg has a groove at its outer end, the bottom of said groove being inclined to constitute a ramp for forcing said boss upwardly as the receptacle is slid onto the horizontal leg.

5. A newspaper delivery receptacle as set forth in claim 4 wherein the boss has a hole to receive a supplemental fastener such as a bolt further to secure said bracket and receptacle.

6. A newspaper delivery receptacle as set forth in claim 1 which further includes gussets between said shoulders and the bottom of the receptacle.

7. A newspaper delivery receptacle having a bottom, sides and a top, closed at one end constituting its back end and open at its front end for insertion of a newspaper therein, and means for mounting said receptacle in generally horizontal position on a post comprising a bracket having a vertical leg adapted to be fastened to the post and a horizontal leg extending laterally outwardly from the vertical leg, and means on the outside of the bottom of the receptacle for slidably receiving said horizontal leg of the bracket, said bottom and said horizontal leg having interengageable snap fastener means for snap-fastening the receptacle to said horizontal leg upon sliding the receptacle into interengagement with said horizontal leg, said means for slidably receiving said horizontal leg comprising a pair of shoulders extending transversely across the outside of the bottom of the receptacle for slidably receiving the side margins of said horizontal leg of the bracket and a pair of ribs extending transversely across the bottom of the receptacle and positioned parallel to and inwardly of said shoulders for engaging said bracket, the horizontal leg of the bracket having a pair of slots open at the outer end of the leg for slidably receiving said ribs, and the portion of said bottom between said ribs and said horizontal leg having said snap fastener means for snap fastening the receptacle to said horizontal leg by sliding the receptacle in a direction transverse to its length and longitudinally of the horizontal leg onto the horizontal leg with the side margins of the horizontal leg in said shoulders and the ribs in said slots.

8. A newspaper delivery receptacle as set forth in claim 7 wherein said ribs have a generally T-shaped cross section with a generally vertical web portion and a generally horizontal flange portion whereby each web portion is slidably received in its respective slot and the flange portions slidably engage the margins of the respective slots on the undersurface of the horizontal leg.

9. A newspaper delivery receptacle as set forth in claim 8 in which said horizontal leg has reinforcing ribs extending across the undersurface thereof and extending generally perpendicularly to and spanning the slots, said reinforcing ribs having openings to receive the flanges of the T-shaped ribs.

* * * * *